US011100904B2

(12) United States Patent
Takemoto et al.

(10) Patent No.: US 11,100,904 B2
(45) Date of Patent: Aug. 24, 2021

(54) IMAGE DRAWING APPARATUS AND DISPLAY APPARATUS WITH INCREASED MEMORY EFFICIENCY

(71) Applicants: Kabushiki Kaisha Toshiba, Tokyo (JP); Toshiba Electronic Devices & Storage Corporation, Tokyo (JP)

(72) Inventors: Takashi Takemoto, Yokohama Kanagawa (JP); Yuji Hisamatsu, Kawasaki Kanagawa (JP); Shinichi Shionoya, Kawasaki Kanagawa (JP); Michio Katsuhara, Tokyo (JP)

(73) Assignees: Kabushiki Kaisha Toshiba, Tokyo (JP); Toshiba Electronic Devices & Storage Corporation, Tokyo (JP)

( * ) Notice: Subject to any disclaimer, the term of this patent is extended or adjusted under 35 U.S.C. 154(b) by 0 days.

(21) Appl. No.: 16/291,001

(22) Filed: Mar. 4, 2019

(65) Prior Publication Data

US 2020/0082797 A1 Mar. 12, 2020

(30) Foreign Application Priority Data

Sep. 11, 2018 (JP) ..... JP2018-169658

(51) Int. Cl.
*G09G 5/395* (2006.01)

(52) U.S. Cl.
CPC ..... *G09G 5/395* (2013.01); *G09G 2360/18* (2013.01)

(58) Field of Classification Search
CPC ..... G09G 5/395; G09G 2360/18; G09G 5/39; G09G 2360/12; G09G 5/38;
(Continued)

(56) References Cited

U.S. PATENT DOCUMENTS 5,581,722 A * 12/1996 Welland ..... G06F 12/023 711/206
2008/0144952 A1* 6/2008 Chen ..... H04N 19/12 382/239

(Continued)

FOREIGN PATENT DOCUMENTS

JP 2013-025376 A 2/2013
JP 2013-030066 A 2/2013
JP 6283980 B 2/2018

OTHER PUBLICATIONS

"Defeat common sense! Round shape, waveform, donut type display appeared?", Aera dot., https://dot.asahi.com/dot/2014062700122.html?, Jun. 29, 2014, p. 1.

(Continued)

*Primary Examiner* — Maurice L. McDowell, Jr.
*Assistant Examiner* — Donna J. Ricks
(74) *Attorney, Agent, or Firm* — White & Case LLP

(57) ABSTRACT

According to embodiments, an image drawing apparatus includes: an SRAM; and a transaction conversion unit configured to convert a transaction based on a virtual address indicating a pixel position in a storage area of the SRAM into a transaction based on a physical address in the SRAM. When the storage area is divided into a plurality of windows in a row direction and a column direction so that each window includes one or more lines, and an assigned area which is assigned the physical address in the SRAM is set in each of the windows, the transaction conversion unit converts the transaction based on the virtual address into the transaction based on the physical address based on whether the pixel position indicated by the virtual address is in the assigned area.

11 Claims, 13 Drawing Sheets

(58) Field of Classification Search
CPC ..... G06F 2212/7201; G06F 12/1027; G06F 12/0223; G06F 3/0644; G06F 9/5016; G06F 12/10; G06F 12/00; G06F 12/023; G06F 12/0292; G06F 12/08; G06F 3/064; G06F 12/02; G06T 1/60; G06T 15/005
See application file for complete search history.

(56) References Cited

U.S. PATENT DOCUMENTS

| | | | | |
|---|---|---|---|---|
| 2013/0027397 | A1 | 1/2013 | Sugama | |
| 2017/0039396 | A1* | 2/2017 | Sharp | G06F 12/1458 |
| 2017/0140501 | A1* | 5/2017 | Hong | G06T 3/606 |
| 2019/0188126 | A1* | 6/2019 | Chun | G11C 16/10 |

OTHER PUBLICATIONS

"STM32L4+—Chrom-GRCTM," Graphic MMU, http://www.st.com/content/ccc/resource/training/technical/product/training/group0/86/43/cf/52/36/6d/49/0c/STM32L4Plus Peripheral GFXMMU/files/STM324L4Plus Peripheral GFXMMU.pdf/jcr content/translations/en.STM32L4Plus Peripheral GFXMMU.pdf, pp. 1-13.

* cited by examiner

FIG. 6

TBL

| WINDOW NUMBER | ASSIGNMENT START BLOCK (SB) | ASSIGNMENT END BLOCK (EB) | HEAD OF PHYSICAL ADDRESSES |
|---|---|---|---|
| WD1 | 6 | 12 | ··· |
| WD2 | 1 | 7 | ··· |
| WD3 | 4 | 12 | ··· |
| WD4 | 1 | 9 | ··· |
| ⋮ | ⋮ | ⋮ | ⋮ |
| WD24 | 1 | 7 | ··· |

FIG. 10

TBL1

| WINDOW NUMBER | ASSIGNMENT START BLOCK (SB1) | ASSIGNMENT END BLOCK (EB1) | ASSIGNMENT START BLOCK (SB2) | ASSIGNMENT END BLOCK (EB2) | HEAD OF PHYSICAL ADDRESSES |
|---|---|---|---|---|---|
| WD1 | 6 | 19 | — | — | ··· |
| WD2 | 4 | 21 | — | — | ··· |
| WD3 | 2 | 8 | 17 | 23 | ··· |
| WD4 | 1 | 7 | 19 | 24 | ··· |
| WD5 | 1 | 4 | 21 | 24 | ··· |
| WD6 | 1 | 4 | 21 | 24 | ··· |
| ⋮ | ⋮ | ⋮ | ⋮ | ⋮ | ⋮ |
| WD12 | 6 | 19 | — | — | ··· |

TBL2

| WINDOW NUMBER | TYPE | HEAD ADDRESS |
|---|---|---|
| WD1 | wt3 | ••• |
| WD2 | wt2 | ••• |
| WD3 | wt2 | ••• |
| WD4 | wt4 | ••• |
| ⋮ | ⋮ | ⋮ |
| WD16 | wt6 | ••• |

FIG. 15

| ADDRESS | DATA | | | |
|---|---|---|---|---|
| +0 | N/A | R0 | G0 | B0 |
| +4 | N/A | R1 | G1 | B1 |
| +8 | N/A | R2 | G2 | B2 |
| | ⋮ | | | |

FIG. 16

| ADDRESS | DATA | | | |
|---|---|---|---|---|
| +0 | B1 | R0 | G0 | B0 |
| +4 | G2 | B2 | R1 | G1 |
| +8 | R3 | G3 | B3 | R2 |
| | ⋮ | | | |

IMAGE DRAWING APPARATUS AND DISPLAY APPARATUS WITH INCREASED MEMORY EFFICIENCY

CROSS-REFERENCE TO RELATED APPLICATION

This application is based upon and claims the benefit of priority from the prior Japanese Patent Application No. 2018-169658 filed in Japan on Sep. 11, 2018; the entire contents of which are incorporated herein by reference.

FIELD

Embodiments described herein relate generally to an image drawing apparatus and a display apparatus.

BACKGROUND

Conventionally, graphic display has been widely performed on a display apparatus. A frame buffer configured to store image data is used to display characters and images on the display apparatus.

The frame buffer is used in performing graphic display not only on a display apparatus with a rectangular display area, but also on a display apparatus with a non-rectangular display area such as a round shape.

However, when the display apparatus has a non-rectangular display area, a problem exists that many unused areas are generated in the frame buffer to decrease memory efficiency.

To address this issue, the embodiments are directed to providing image drawing apparatuses which improve memory efficiency of a frame buffer.

BRIEF DESCRIPTION OF THE DRAWINGS

FIG. 6 is a diagram showing an example of a table configured to store information on an assignment start block from which assignment of a physical address in each window is started and an assignment end block at which assignment of a physical address ends, and information on a head address of each window, according to the first embodiment;

FIG. 10 is a diagram showing another example of a table configured to store information on assignment start blocks from which assignment of physical addresses in each window is started and assignment end blocks at which assignment of physical addresses ends, and information on a head address of each window, according to the first embodiment;

FIG. 15 is a diagram showing arrangement of data when upper 8 bits are not truncated, according to a variation of the first and second embodiments;

FIG. 16 is a diagram showing arrangement of data when upper 8 bits of each pixel data are truncated so as not to be used, according to the variation of the first and second embodiments.

DETAILED DESCRIPTION

An image drawing apparatus according to an embodiment includes: a rewritable memory including a frame buffer capable of storing image data in a rectangular storage area; and a transaction conversion unit configured to convert a transaction based on a virtual address indicating a pixel position in the storage area into a transaction based on a physical address in the memory, and when the storage area is divided into a plurality of windows in a row direction and a column direction so that each of the windows includes one or more lines, and an assigned area which is assigned the physical address in the memory is set in each of the windows, configured to convert the transaction based on the virtual address into the transaction based on the physical address based on whether the pixel position indicated by the virtual address is in the assigned area.

Embodiments will be described below with reference to the drawings.

First Embodiment (Configuration)

Figure 1:
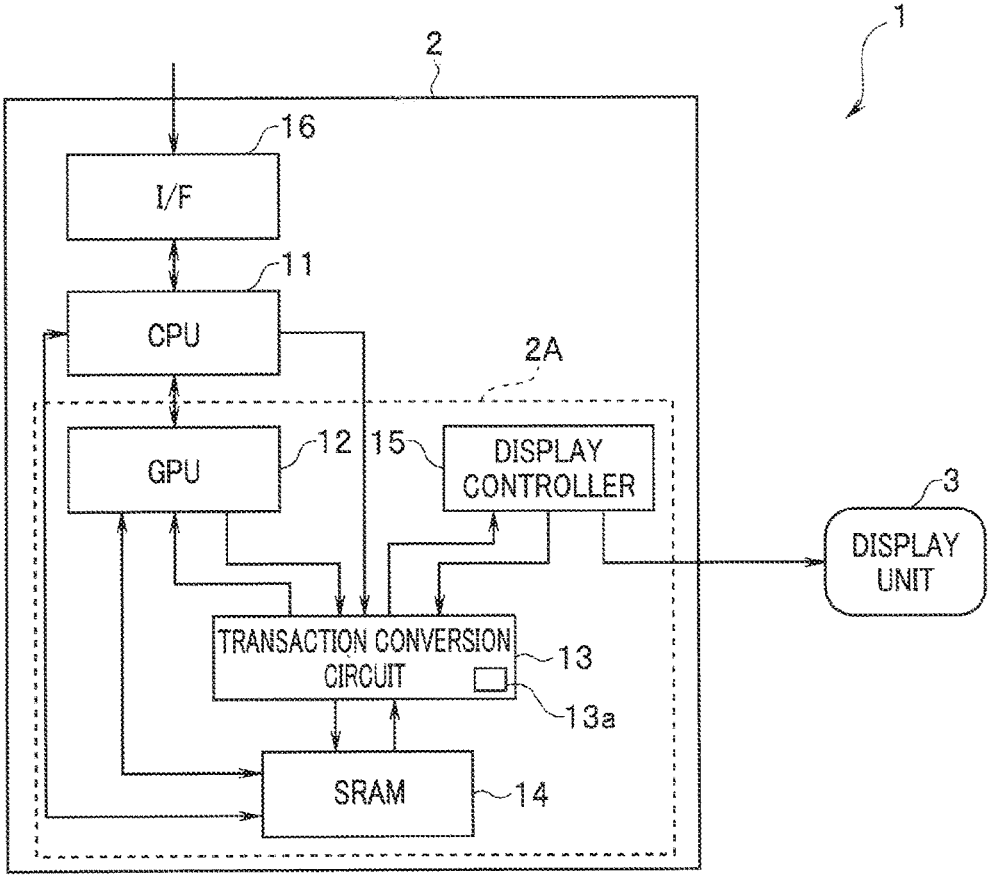
FIG. 1 is a block diagram showing a configuration of equipment having an image drawing apparatus according to a first embodiment.

FIG. 1 is a block diagram showing a configuration of equipment having an image drawing apparatus according to the embodiment. Equipment 1 includes a control unit 2 and a display unit 3. The equipment 1 is, for example, wearable equipment, a mobile terminal, IoT (Internet of Things) equipment, or display equipment mounted on an automobile.

The control unit 2 includes a central processing unit (hereinafter referred to as a CPU) 11, a graphics processing unit (hereinafter referred to as a GPU) 12, a transaction conversion circuit 13, an SRAM 14, a display controller 15 and an interface circuit (hereinafter abbreviated as an I/F) 16. The control unit 2 is, for example, a one-chip semiconductor apparatus.

Although the control unit 2 includes various circuits for controlling operation of the entire equipment 1, only circuits related to drawing are shown here. Although the equipment 1 also includes various apparatuses for various functions, the various apparatuses are omitted here.

The GPU 12, the transaction conversion circuit 13, the SRAM 14 and the display controller 15 constitute an image drawing apparatus 2A.

The display unit 3 is a liquid crystal display (LCD) apparatus, and is connected to the display controller 15 in the image drawing apparatus 2A. Note that the display unit may not be an LCD, but be another display apparatus such as an organic EL (electro-luminescence) apparatus.

Figure 2:
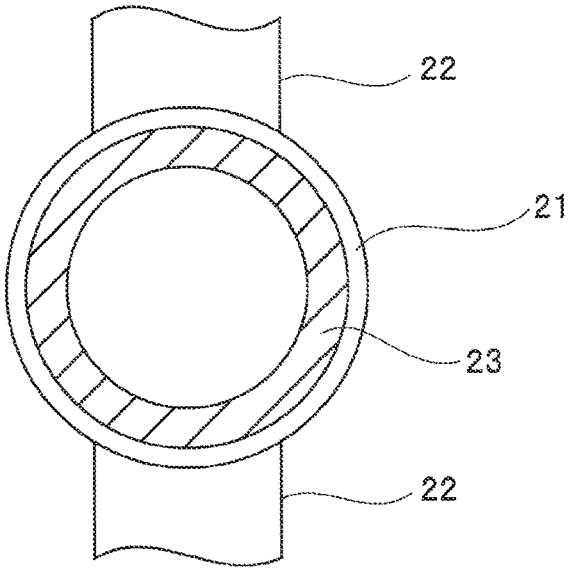
FIG. 2 is an external view of the equipment having the image drawing apparatus, according to the first embodiment.

FIG. 2 is an external view of the equipment having the image drawing apparatus according to the embodiment. The equipment 1 is wristband-type equipment, and has a case body 21, and two bands 22 extending from the case body 21 as shown in FIG. 2. One end of each band is connected and secured to the case body 21. The other end of each band is provided with a clasp (not shown).

The case body 21 incorporates various circuit boards, a battery, and the like. The case body 21 has a disc shape, and a display area 23 of the display unit 3 is exposed on a surface of the case body 21. As shown in FIG. 2, the display area 23 of the display unit 3 in the equipment 1 is annular. That is, the display unit 3 has the annular display area 23. Not only characters and numbers but also figures are displayed in the display area 23.

A user can wear the equipment 1 on the user's arm using the clasps not shown in such a manner that a back of the case body 21 touches the arm.

When receiving through the I/F 16 a request signal from an operation button (not shown) provided on the equipment 1, the CPU 11 executes processing corresponding to the received request signal. The CPU 11 controls overall operation of the equipment 1.

The CPU 11 controls overall operation of the equipment 1 while using the SRAM 14 as a main memory. Depending on the received request signal, the CPU 11 reads a program stored in a ROM not shown to expand on the SRAM 14 and execute the program, or reads the program stored in the ROM not shown to execute the program directly.

The CPU 11 can perform desired graphic display on the display unit 3 by outputting to the GPU 12 a control signal for executing a command signal for drawing (hereinafter referred to as a drawing command).

The GPU 12 executes a program for graphics processing corresponding to the drawing command stored in the SRAM 14 based on a control signal from the CPU 11. That is, when receiving a control signal related to execution of the drawing command from the CPU 11, the GPU 12, depending on the received control signal, reads a program corresponding to the instructed drawing command from the SRAM 14 for execution, or interrupts a program of the drawing command during execution to return to an IDLE state, etc. A control signal from the CPU 11 includes information on an interruption condition of the GPU 12.

The GPU 12 writes image data obtained by execution in a frame buffer in the SRAM 14. A transaction of the GPU 12 for accessing the frame buffer is made based on a virtual address on the assumption of a rectangular frame buffer. That is, the GPU 12 performs, for the SRAM 14, writing and reading processing of image data based on a virtual address corresponding to a rectangular storage area.

The transaction conversion circuit 13 constitutes a transaction conversion unit configured to convert a transaction based on a virtual address into a transaction based on a physical address in the memory. A virtual address indicates a pixel position in the rectangular storage area of the SRAM 14. The transaction conversion circuit 13 may be composed of a processor such as a CPU, or may be composed of a hardware circuit.

The transaction conversion circuit 13 includes an SRAM 13*a* as a memory. Data of TBL (FIG. 6) described later is stored in the SRAM 13*a*. The data of TBL (FIG. 6) is directly transmitted in advance from the CPU 11 to the transaction conversion circuit 13 as control data, and is stored in the SRAM 13*a*.

That is, a virtual address-based transaction from the GPU 12 is converted into a physical address-based transaction in the transaction conversion circuit 13. At this time, an area which does not need to be transferred to the display unit 3 (an area not displayed actually) is not assigned a physical address in the SRAM 14.

That is, an address of an area which is not displayed on the display unit 3 among virtual addresses is not assigned to a physical address in the SRAM 14. Access from the transaction conversion circuit 13 to the SRAM 14 is performed using the physical address-based transaction.

The SRAM 14 functions as a frame buffer. The SRAM 14 with low power consumption is used as a memory for graphics here.

Figure 3:
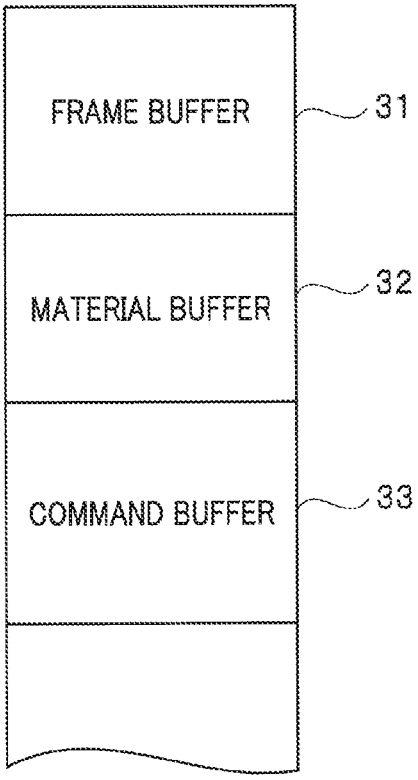
FIG. 3 shows a memory map of an SRAM according to the first embodiment.

FIG. 3 shows a memory map of the SRAM 14. A memory area of the SRAM 14 includes a frame buffer 31, a material buffer 32, and a command buffer 33. Although not shown in the figure, the SRAM 14 further has an area for storing various programs for the CPU 11.

The frame buffer 31 is a memory area for holding image data of the display area 23 in the display unit 3. The frame buffer 31 is a memory area capable of storing image data for one screen of the annular display area 23 here. That is, the SRAM 14 is a rewritable memory including the frame buffer 31 in which image data can be stored in the rectangular storage area.

The material buffer 32 is an off-screen area, and is a memory area for holding material data for various displays such as character fonts, icons, and figures. That is, the material buffer 32 stores intermediate data which is a source of drawing. The intermediate data is image data of a vector font created by the CPU 11 or the like on the fly, etc. For example, reference data of a character font which is dot data is stored in the material buffer 32, and the GPU 12 performs processing such as enlargement and rotation on the reference data of the character font for writing in the frame buffer 31.

Data in the material buffer 32 is created on the fly, or, for example, copied from an external memory not shown such as a ROM and stored in the SRAM 14 when the equipment 1 is powered up or an application is started.

The command buffer 33 is an off-screen area, and is a memory area for storing various commands for drawing. When the CPU 11 instructs the GPU 12 to execute a drawing command, the GPU 12 reads a program corresponding to the instructed drawing command from the command buffer 33 for execution. When execution of the read program has ended, the GPU 12 notifies the CPU 11 that execution of the instructed drawing command has ended.

Data and a program in the command buffer 33 are also copied by the CPU 11 from an external memory not shown such as a ROM and stored in the SRAM 14 when the equipment 1 is powered up.

Returning to FIG. 1, the display controller 15 outputs a read address signal for acquiring image data to be displayed on the display unit 3 to the transaction conversion circuit 13 at a constant cycle, and acquires image data from the SRAM 14.

The transaction conversion circuit 13 acquires image data from the frame buffer 31 in the SRAM 14 for output to the display controller 15 based on the read address signal from the display controller 15.

The display controller 15 outputs the image data acquired from the transaction conversion circuit 13 to the display unit 3. Note that the image data from the display controller 15 is supplied to the display unit 3 via a display interface not shown.

Access from the display controller 15 to the SRAM 14 is also a virtual address-based transaction, and a virtual address-based transaction is converted into a physical address-based transaction in the transaction conversion circuit 13 similarly to access from the GPU to the SRAM 14.

Note that the transaction conversion circuit 13 can be configured so that a response to the display controller 15 as a master controller includes information indicating whether a corresponding access is access to an "unassigned area" described later. The display controller 15 can suppress transmission of image data corresponding to unassigned areas based on the information.

For example, the display controller 15 may have a function of performing processing of skipping transmission. In the case, when a response to read access to the frame buffer 31 indicates an "unassigned area", the display controller 15 skips transmission of image data to the display unit 3 related to the corresponding access. As described later, an unassigned area is an area not assigned a physical address.

More specifically, the GPU 12 and the display controller 15 read and write image data in units of blocks described later. Therefore, when read access from the display controller 15 as a master controller is access to a block not assigned a physical address, the transaction conversion circuit 13 returns a predetermined code to the master controller.

When receiving the predetermined code, the display controller 15 does not transmit image data to the display unit 3. Therefore, when the transaction conversion circuit 13 returns the predetermined code to the master controller, the display controller 15 does not transmit data to the display unit 3, so that wasteful data transmission from the image drawing apparatus 2A to the display unit 3 can be reduced.

That is, the display controller 15 as a master module configured to control output of image data as display data to the display unit 3 does not output image data to the display unit 3 when receiving the predetermined code.

Figure 4:
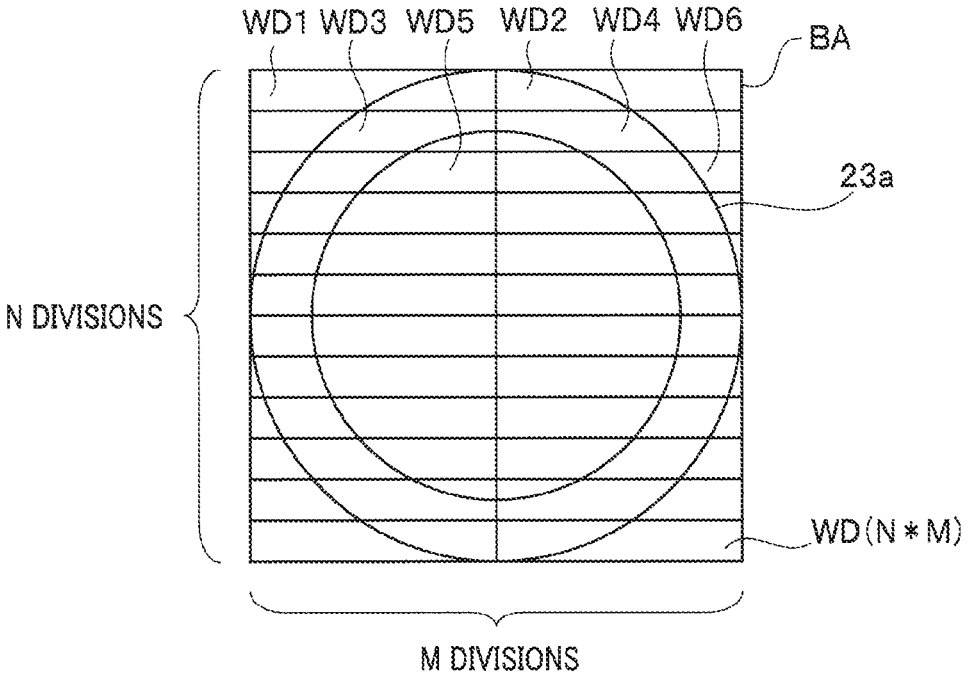
FIG. 4 is a diagram showing an example in which a rectangular virtual buffer area including an area corresponding to an annular display area of a display unit is divided into a plurality of window areas, according to the first embodiment.
Figure 5:
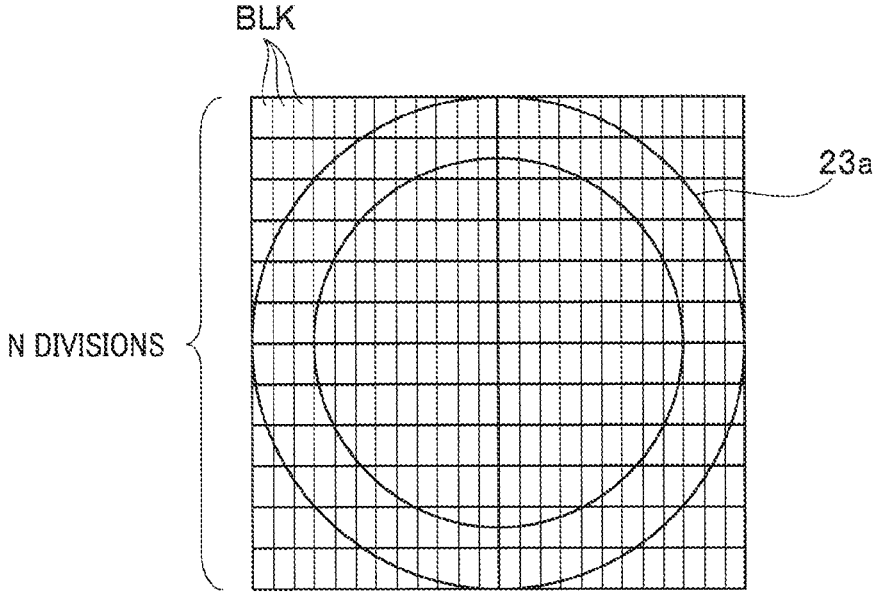
FIG. 5 is a diagram showing an example in which each window area is divided into a plurality of block areas, according to the first embodiment.

A method of address conversion processing in the transaction conversion circuit 13 will be described. FIG. 4 and FIG. 5 are diagrams showing division examples of the rectangular storage area of the frame buffer 31. A rectangular area (hereinafter referred to as a virtual buffer area) BA in FIG. 4 and FIG. 5 is a rectangular storage area in which the frame buffer 31 can store image data.

FIG. 4 is a diagram showing an example in which the rectangular virtual buffer area BA including an area 23*a* corresponding to the annular display area (so-called donut-shaped display area) 23 of the display unit 3 is divided into a plurality of window areas. FIG. 5 is a diagram showing an example in which each window area is divided into a plurality of block areas.

As shown in FIG. 4, when the annular area 23*a* is arranged to be included within the virtual buffer area BA of a virtual frame buffer, the virtual buffer area BA is divided into M pieces in a lateral direction (row direction), and is divided into N pieces in a longitudinal direction (column direction). M and N are any integers, and are set according to a shape of the display area 23 in the display unit 3. M is 2 and N is 12 here.

When it is desired to suppress assignment of undisplayed portions to physical addresses as much as possible, N is preferably set to the number of lines in a screen. In this case, the height of a window is one pixel.

In FIG. 4, window numbers are set for 24 windows in the virtual buffer area BA from the upper left to the lower right.

Furthermore, as shown in FIG. 5, each window WD is divided into a plurality of blocks BLK. The plurality of windows WD have a same size and shape as one another. The plurality of blocks BLK also have a same size and shape as one another.

Examples of assigning physical addresses in each window WD in FIG. 4 and FIG. 5 will be described. As shown in FIG. 5, each window WD is formed in such a manner that the plurality of blocks BLK are arranged in a line direction.

Although a lateral width (the number of pixels in the lateral direction) of each block is optional, the lateral width is one pixel when it is desired to suppress assignment of physical addresses to undisplayed portions as much as possible. Positions of an "assignment start block" and an "assignment end block" are specified for each window WD as information for specifying a portion to be assigned physical addresses in the SRAM 14. Head address information assigned to each window WD is also needed.

Therefore, a table is used which stores information on a block from which assignment of a physical address in each window is started and a block at which the assignment ends, and information on the head address of each window.

FIG. 6 is a diagram showing an example of a table configured to store information on an assignment start block (SB) from which assignment of a physical address in each window is started and an assignment end block (EB) at which assignment of a physical address ends, and information on a head address of each window. The table TBL is stored in the SRAM 13*a* of the transaction conversion circuit 13.

As shown in FIG. 6, information on the assignment start block (SB), the assignment end block (EB), and the head address of physical addresses are set for the table TBL for each window number.

That is, the table TBL is a table storing information on the assignment start block (SB) and the assignment end block (EB) for each window, and a physical address of each window.

Therefore, the transaction conversion circuit 13 determines based on FIG. 6 whether any block has been assigned a physical address as described later.

Note that a table data buffer 34 may be stored in the SRAM 14.

As described above, each window includes a plurality of blocks BLK, and an assigned area is set in units of blocks. An assigned area is specified by the assignment start block from which the assigned area is started, and the assignment end block at which the assigned area ends in each window.

Figure 7:
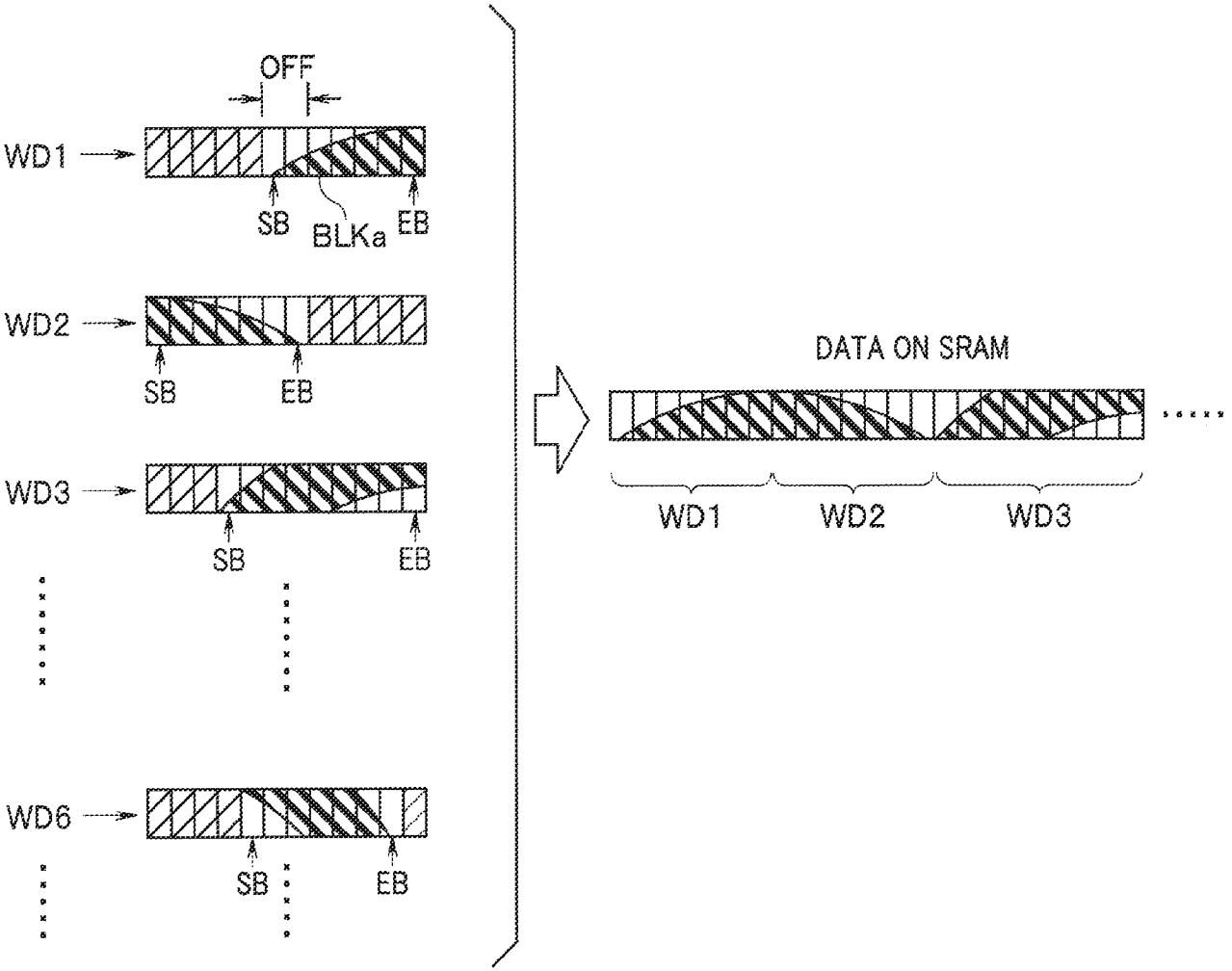
FIG. 7 is a diagram for explaining a method of storing data of blocks in a plurality of windows, according to the first embodiment.

FIG. 7 is a diagram for explaining a method of storing data of blocks in a plurality of windows. FIG. 7 shows storage of data in a plurality of blocks of image data in the area 23*a* shown in FIG. 5.

For example, 1st to 5th blocks from the left among the plurality of blocks BLK in a window WD1 are an area not assigned to the display area 23 of the display unit 3. 6th to 12th blocks from the left are an area assigned to the display area 23 of the display unit 3.

A thin hatched line block is an area not assigned to the display area 23 of the display unit 3, and a block including a thick hatched line area is an area assigned to the display area 23 of the display unit 3.

Similarly, 1st to 7th blocks from the left among the plurality of blocks BLK in a window WD2 are an area assigned to the display area 23 of the display unit 3. 8th to 12th blocks from the left are an area not assigned to the display area 23 of the display unit 3.

That is, blocks which are assigned physical addresses in the SRAM 14 and blocks which are not assigned physical addresses in the SRAM 14 exist in the virtual buffer area BA corresponding to virtual addresses.

In the embodiment, for addresses of blocks which are assigned physical addresses in the SRAM 14 among addresses specified by virtual addresses from a master module such as the GPU 12, image data is stored in the frame buffer 31 of the SRAM 14.

Therefore, image data of blocks which are not assigned physical addresses in the SRAM 14 is not stored in the frame buffer 31.

As shown in FIG. 7, image data of 6th to 12th blocks from the left in the window WD1 is stored in the frame buffer 31 of the SRAM 14, image data of 1st to 7th blocks from the left in the window WD2 is stored in the frame buffer 31 of the SRAM 14, and image data of 4th to 12th blocks from the left in the window WD3 is stored in the frame buffer 31 of the SRAM 14.

Also in another window WD, similarly, only image data of blocks which are assigned physical addresses in the SRAM 14 is stored in the frame buffer 31 of the SRAM 14. That is, data of blocks not assigned physical addresses is not included in the frame buffer 31 of the SRAM 14.

Note that three pieces of information on each window (the position of the assignment start block, the position of the assignment end block, and the head address of physical addresses described above) are stored in TBL of FIG. 6 as described above, and the number of windows increases and a table size increases when the number of divisions N in the longitudinal direction, or the column direction, is large.

In such a case, it is preferable to set the height of a window to two pixels or more to decrease the number of divisions N in the longitudinal direction. However, as the number of divisions N is increased, efficiency in suppressing assignment of undisplayed portions to the SRAM 14 lowers. Although the lateral width of a block may be set to be large for easy implementation, a trade-off with assignment efficiency exists similarly.

(Operation)

Figure 8:
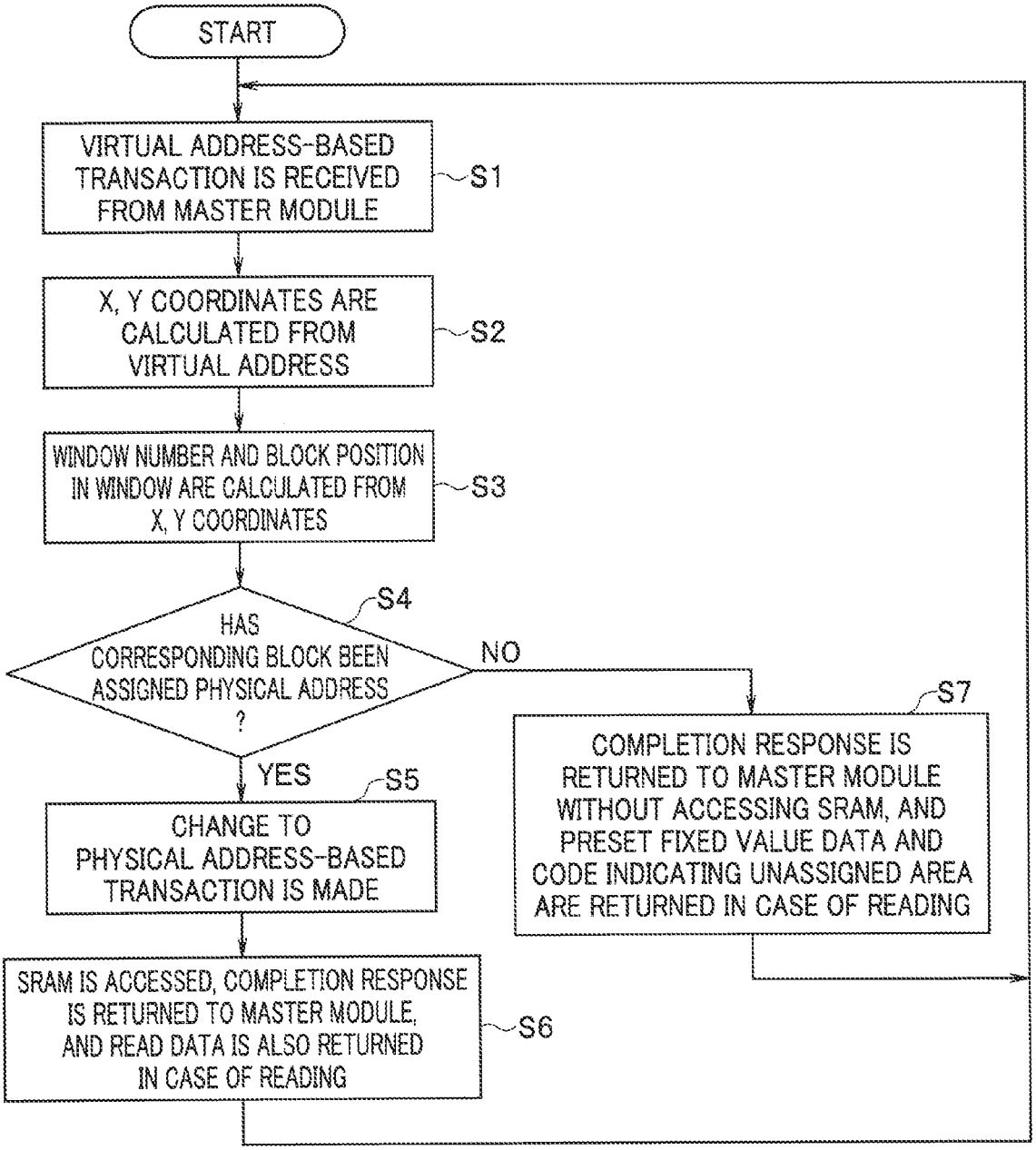
FIG. 8 is a flowchart showing an example of a flow of processing by a transaction conversion circuit, according to the first embodiment.

FIG. 8 is a flowchart showing an example of a flow of processing by a transaction conversion circuit 13.

As described above, the transaction conversion circuit 13 receives a transaction from the GPU 12 and the display controller 15, and executes various processing.

That is, the transaction conversion circuit 13 receives a transaction for access to the frame buffer 31 from the GPU 12 or the display controller 15 as a master module (step (hereinafter abbreviated as S) 1). The transaction received by the transaction conversion circuit 13 from the master module is a virtual address-based transaction.

The transaction conversion circuit 13 extracts X, Y coordinates in the virtual buffer area BA from a virtual address of the received transaction (S2). For example, when it is assumed that the lateral size of the virtual buffer area BA is 4096 bytes (corresponding to 1024 pixels in the case of 32 bits/pixel) and the longitudinal size is 1024 lines, the X coordinate has 10 bits from bit 11 to bit 2 of a virtual address, and 10 bits from bit 21 to bit 12 of the virtual address are extracted as the Y coordinate.

For example, a virtual address VA is specified by the following equation (1).

$$VA=1024\times Y+X \tag{1}$$

Therefore, the transaction conversion circuit 13 can obtain the X, Y coordinates related to the transaction from the virtual address VA by back calculation from the equation (1).

The transaction conversion circuit 13 calculates a window number and a block position in the window from the X, Y coordinates (S3). That is, the window number to which the X, Y coordinates calculated in S2 belong and the block position are calculated.

The window number is calculated from the following equation (2).

$$\text{(window number)}=\text{floor}(M\times(Y/\text{window height}))+\text{floor}((X/\text{window width})) \tag{2}$$

The window height is the number of pixels in the Y direction of one window in the virtual buffer area BA, and the window width is the number of pixels in the X direction of one window in the virtual buffer area BA.

The position of a corresponding block is calculated from the following equation (3).

$$\text{(position of corresponding block)}=\text{floor}((X\text{ coordinate in pixel, mod window width})/\text{block lateral width}) \tag{3}$$

Here, mod is an operator for calculating a remainder, floor is a function to truncate a fractional portion, and block lateral width is the number of pixels of one block in the X direction.

Note that although the equation (3) is used to calculate the window number to which the X, Y coordinates belong and the block position here, a table may be used which stores information on the window number and the block position corresponding to the X, Y coordinate values. The table is stored in the SRAM 13*a* of the transaction conversion circuit 13, and the transaction conversion circuit 13 can obtain the window number and the corresponding block position from the X, Y coordinates with reference to the table stored in the SRAM 13*a*.

After S3, the transaction conversion circuit 13 refers to the table TBL in FIG. 6 to determine whether the corresponding block BLK has been assigned a physical address (S4). That is, it is determined whether the corresponding block is an unassigned area not assigned a physical address.

It can be determined whether the corresponding block is an unassigned area using such a condition as follows.

if (corresponding block position<assignment start block position or
corresponding block position>assignment end block position),
then corresponding block is unassigned area When the corresponding block BLK has been assigned a physical address (S4: YES), the transaction conversion circuit 13 changes a received virtual address-based transaction to a physical address-based transaction (S5).

The head address of the physical addresses of each block is calculated from the following equation (4).

$$\text{(physical address of corresponding block)}=\text{(head address of corresponding window)}+\text{(data size per block}\times\text{(corresponding block position}-\text{assignment start block position)} \tag{4}$$

For example, when the corresponding block is BLKa in FIG. 7, "(data size per block×(corresponding block position–assignment start block position)" in the equation (4) represents an offset amount OFF from the head address of the corresponding window WD1 to the corresponding block.

As described above, when the rectangular storage area of the frame buffer 31 is divided into a plurality of windows in the row direction and the column direction so that each window includes one or more lines, and an assigned area which is assigned a physical address in the SRAM 14 is set in each window, the transaction conversion circuit 13 converts a transaction based on a virtual address into a transaction based on a physical address based on whether a pixel position indicated by the virtual address is in the assigned area.

After S5, the transaction conversion circuit 13 accesses the SRAM 14 based on the physical address-based transaction, and returns a completion response to a master module, or returns the completion response with read data in the case of reading (S6).

When the corresponding block BLK has not been assigned a physical address (S4: NO), the transaction conversion circuit 13 returns a completion response to the master module without accessing the SRAM 14, and returns preset fixed value data and a code indicating an unassigned area in the case of reading (S7).

That is, when the virtual address-based transaction is a transaction for an unassigned area which is not an assigned area, the transaction conversion circuit 13 transmits the predetermined code to a master module which has outputted the virtual address-based transaction without accessing the SRAM 14.

As described above, in the above embodiment, the transaction conversion circuit 13 converts a virtual address-based transaction into a physical address-based transaction as shown in FIG. 8, and the SRAM 14 stores only image data of blocks which are assigned physical addresses as shown in FIG. 7.

A block shown by thin hatched lines in FIG. 7 is an unassigned block. As can be seen from the figure, image data is arranged in the SRAM 14 in a form in which portions of unassigned blocks are truncated.

Furthermore, when the corresponding block is an unassigned area, a completion response is returned without accessing the SRAM 14 as shown in S7 in FIG. 8 and when the corresponding block is an assigned area, the SRAM 14 is accessed, and a completion response is returned with read data in the case of reading as shown in S6.

Note that although the frame buffer is divided into a plurality of pieces in the longitudinal direction (column direction), and is also divided into a plurality of pieces (M=2 in the above example) in the lateral direction (row direction) in the above embodiment, the frame buffer may not be divided in the lateral direction. That is, M may be 1.

Figure 9:
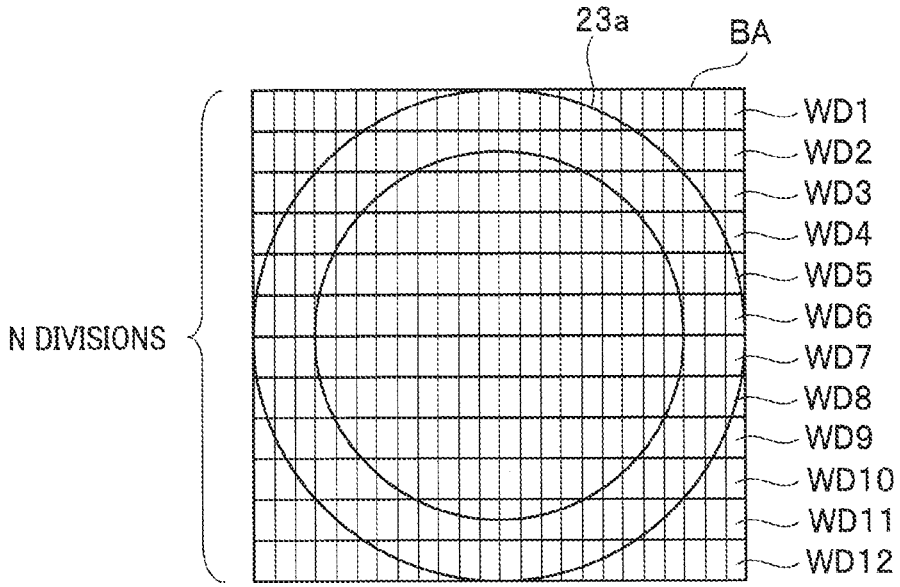
FIG. 9 is a diagram for explaining another example of division of a display area, according to the first embodiment.

FIG. 9 is a diagram for explaining another example of division of the display area. FIG. 9 is a diagram showing an example in which the rectangular virtual buffer area BA including the area 23*a* corresponding to the annular display area 23, that is, a so-called donut-shaped display area of the display unit 3 is divided into a plurality of window areas with M=1, and each window area is divided into a plurality of block areas.

FIG. 10 is a diagram showing an example of a table configured to store information on assignment start blocks from which assignment of physical addresses in each window shown in FIG. 9 is started and assignment end blocks at which assignment of physical addresses ends, and information on a head address of each window.

Since the display area 23 of the display unit 3 is annular here, the table TBL1 stores information on the positions of two assignment start blocks and two assignment end blocks. An assignment start block (SB1) and an assignment end block (EB1) constitute a pair for a first assigned area, and an assignment start block (SB2) and an assignment end block (EB2) constitute a pair for a second assigned area. Two pairs, that is, two assigned areas can be set per window.

That is, the table TBL1 can store a plurality of assignment start blocks (SB) and a plurality of assignment end blocks (EB) for each window.

The transaction conversion circuit 13 refers to the table TBL1 in FIG. 10 to determine whether the corresponding block BLK has been assigned a physical address in S4 in FIG. 8.

In the case, the physical address can be generated by the following processing.

if (corresponding block is in first assigned area), then
physical address of corresponding block=
head address of corresponding window+
data size per block×
(corresponding block position–first assignment start block position) else
physical address of corresponding block
head address of corresponding window+
data size per block×
((first assignment end block position–first assignment start block position)+
(corresponding block position–second assignment start block position))

Although the number of necessary windows can be reduced in the case, it is necessary to refer to information on all assigned blocks in the corresponding window when generating a physical address, so that the calculation becomes troublesome. Therefore, it is preferable to set the number of assigned areas per window to 2-3 at most.

Accordingly, when the rectangular storage area of the frame buffer 31 is divided into a plurality of windows in the column direction so that each window includes one or more lines, and an assigned area which is assigned a physical address in the SRAM 14 is set in each window, the transaction conversion circuit 13 determines an assigned area based on the table TBL1 storing a plurality of assignment start positions and a plurality of assignment end positions for each window, and converts a transaction based on a virtual address into a transaction based on a physical address based on whether a pixel position indicated by the virtual address is in the assigned area.

If the display area 23 of the display unit 3 as a display apparatus has an annular, that is, donut shape, and when the table TBL only has a pair of pieces of information on an assignment start block position and an assignment end block position as shown in FIG. 6, data in a circular area inside the annular display area 23 is also stored in the SRAM 14, resulting in a wasteful memory area.

Although a pair of pieces of information on a start block position and an end block position as shown in FIG. 6 does not generate a wasteful memory area when the display area of the display unit 3 is circular, many wasteful memory areas are generated when the display area has an annular shape, or various shapes such as alphabetic characters as described above.

Furthermore, although a method also exists for storing information on a pair of a start position and an end position of a display area in the frame buffer for each line together with image data, data of a central undisplayed area in the annular display area is also included in image data when using such a method, so that a wasteful area is included in the frame buffer, resulting in poor memory efficiency.

However, the table TBL1 as shown in FIG. 10 can be configured to include information on a plurality of assignment start blocks (SB) and a plurality of assignment end blocks (EB) in each window, so that wasteful areas may not be included in the frame buffer 31.

As described above, according to the above embodiment, it is possible to provide an image drawing apparatus which improves memory efficiency of a frame buffer.

Second Embodiment

Although the first embodiment uses the table TBL or TBL1 to determine whether the corresponding block is a block assigned a physical address in each window, the embodiment divides a virtual buffer area based on virtual addresses using different types of windows, and does not use a table such as in the first embodiment. Each type of window has a plurality of blocks, and a block having an assigned area is determined in advance among the plurality of blocks.

Figure 11:
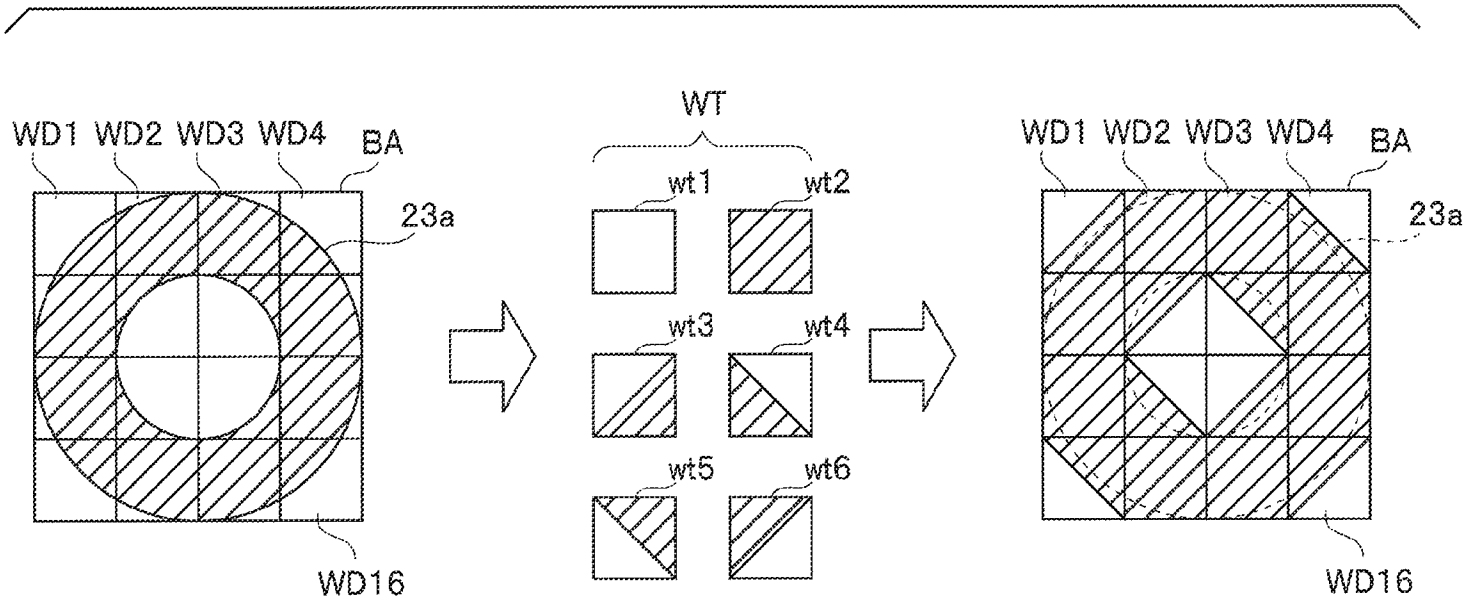
FIG. 11 is a diagram for explaining division of a virtual buffer area according to a second embodiment.

FIG. 11 is a diagram for explaining division of the virtual buffer area in the embodiment. FIG. 11 shows an example in which a rectangular virtual buffer area BA including the area 23*a* corresponding to the annular display area 23, that is, a so-called donut-shaped display area of the display unit 3 is divided into a plurality of window areas.

As shown in FIG. 11, the rectangular virtual buffer area BA is divided into a smaller number of windows than in the first embodiment. The virtual buffer area BA is divided into 16 pieces here.

In FIG. 11, each window has a square shape. Since the size of each window is large, efficiency in eliminating undisplayed portions is poor when using a simple specifying method based on an assignment start block and an assignment end block used in the first embodiment.

So, here, for example, each window is classified into six types wt1 to wt6 as shown by a window type WT. The type wt1 indicates a type in which the whole window is an unassigned area. An unassigned area is an area not assigned a physical address in the SRAM 14.

The type wt2 indicates a type in which the whole window is an assigned area. An assigned area is an area assigned a physical address in the SRAM 14.

The type wt3 indicates a type in which the lower right area of a diagonal line from the upper right to the lower left of the rectangular window is an assigned area. The type wt4 indicates a type in which the lower left area of a diagonal line from the upper left to the lower right of the rectangular window is an assigned area. The type wt5 indicates a type in which the upper right area of a diagonal line from the upper left to the lower right of the rectangular window is an assigned area. The type wt6 indicates a type in which the upper right area of a diagonal line from the upper right to the lower left of the rectangular window is an assigned area.

According to such a configuration, information on assignment per window should just include a 3-bit flag indicating the six types, and a head address assigned to each window. That is, an assigned area is set in advance according to the type of each window.

Therefore, since the number of windows is only 16, it is possible to hold all information in a register with a small capacity (not shown) without using an SRAM.

Figures 12, 13:
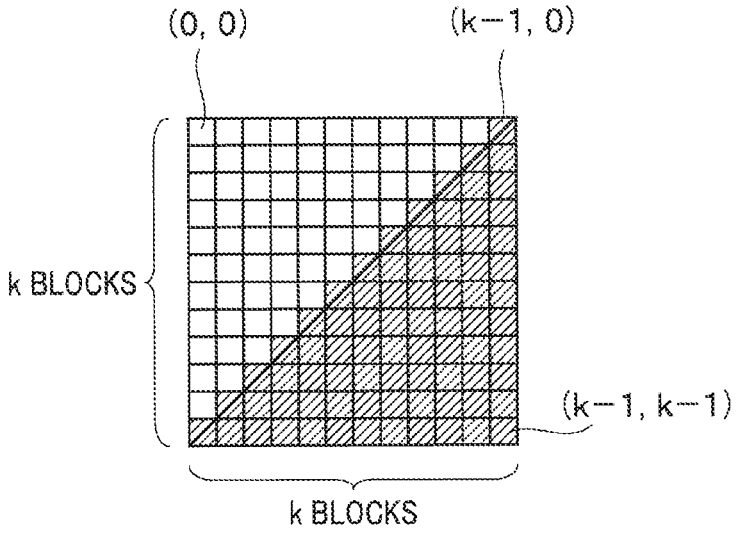
FIG. 12 is a diagram showing an example of a table of window information according to the second embodiment.
FIG. 13 is a diagram showing arrangement of blocks in a window taking a particular type as an example, according to the second embodiment.

FIG. 12 is a diagram showing an example of a table of window information. In a table TBL2 shown in FIG. 12, for each window number, information on a type of the window and a head address of physical addresses of the window can be stored in any register.

Each window is divided into a plurality of blocks. The physical address of each block can be calculated using a simple calculation formula.

FIG. 13 is a diagram showing arrangement of blocks in a window taking the type wt3 as an example. Here, each window is divided into a plurality of (here, k×k) blocks. A positive integer is set as k. In FIG. 13, a block with hatched lines is an assigned area, and a block without hatched lines is an unassigned area.

The transaction conversion circuit 13 calculates X, Y coordinates from a virtual address of a received transaction in S2 in FIG. 8, and the transaction conversion circuit 13 calculates a block position (i, j) from the calculated X, Y based on longitudinal and lateral sizes of each block. Furthermore, the transaction conversion circuit 13 calculates a window number based on the above equation (2) assuming that M and N are 4 in S3 in FIG. 8.

A physical address of a block at a position (i, j) in a window is calculated from the following equation (5). Here, $0 \leq i$ and $j \leq 11$.

$$\text{physical address of } (i,j)\text{block} = \text{head address of corresponding window} + \text{data size per block} \times ((i+j-k+1)+(j \times j+j)/2) \quad (5)$$

Also in another window, similarly, an equation corresponding to the shape of each window is used to calculate the physical address of a block from i, j.

Note that although the sizes of the plurality of windows are equal to one another in FIG. 11, the sizes may be different.

Figure 14:
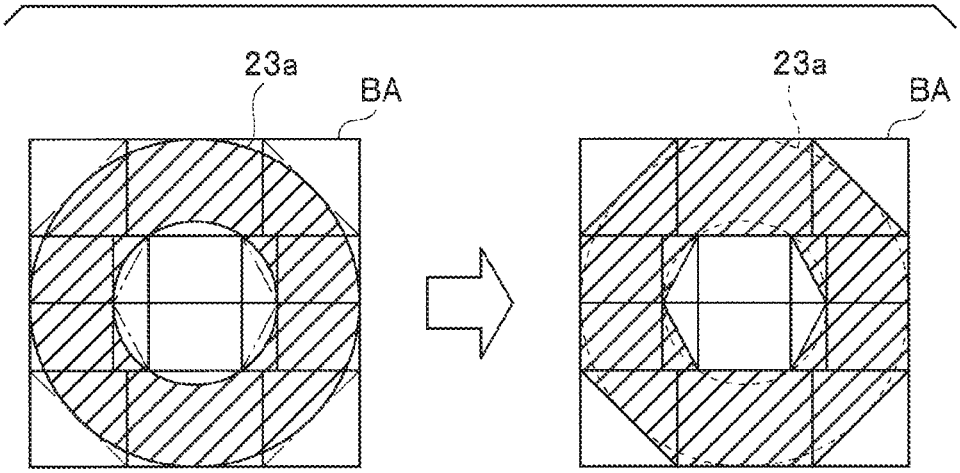
FIG. 14 is a diagram showing an example of division of the virtual buffer area when sizes of a plurality of windows are differentiated from one another, according to the second embodiment.

FIG. 14 is a diagram showing an example of division of the virtual buffer area BA when sizes of a plurality of windows are differentiated from one another.

Although division in FIG. 14 has a same number of windows as division in FIG. 11, efficiency in eliminating undisplayed portions can be made higher in FIG. 14.

Therefore, according to the above second embodiment, it is possible to provide an image drawing apparatus which improves memory efficiency of a frame buffer.

(Variation)

Although each above embodiment has described a method of suppressing assignment of physical addresses in the SRAM 14 to undisplayed areas, when pixel data has unnecessary bits, it may be possible to further suppress assignment of the SRAM 14 to the unnecessary bits.

For example, if the GPU 12 does not support data with 24 bits/pixel and only support a data format with 32 bits/pixel, and when a component data is not used, upper 8 bits in 32 bits may be truncated for storage in the SRAM 14.

FIG. 15 and FIG. 16 are diagrams showing arrangement examples of data into the SRAM 14 when a component data is not used. FIG. 15 shows arrangement of data when upper 8 bits are not truncated, and FIG. 16 shows arrangement of data when upper 8 bits of each pixel data are truncated so as not to be used.

In FIG. 15, upper 8 bits for an unused a component is N/A (Not Available), and an unused area is generated.

In contrast, since the unused upper 8 bits are not used in FIG. 16, and truncated image data is stored in the SRAM 14, no unused area is generated. In the case of FIG. 16, not only address conversion but also recombination of byte positions of data are performed. Truncation of data and recombination of byte positions are executed in S5 in FIG. 8.

That is, only pixel data related to color information of an image is stored in the SRAM 14.

Therefore, since wasteful data is not stored in the SRAM 14, the SRAM 14 can be reduced in size.

As described above, according to each embodiment and the variation described above, it is possible to provide an image drawing apparatus which improves memory efficiency of a frame buffer.

Especially, since each embodiment and the variation described above use the SRAM 14 as a memory for drawing, the image drawing apparatus is reduced in power consumption.

Not only is the above image drawing apparatus applicable to a display apparatus having a display area in various shapes, but also actual memory capacity and power consumption can be reduced in a normal rectangular display device.

Some display apparatuses such as the display unit 3 have a function of holding an image once displayed. For example, some display apparatuses have a function of, once receiving image data of a particular display area from the display controller 15, holding the image data and continuously displaying an image of the display area.

For example, the rectangular display area of a display apparatus is divided into a background image and a foreground image, and only the background image is first drawn and transferred to the display apparatus. For example, the foreground image is regarded as an undisplayed area, so that image data of the foreground image is not assigned a memory area in the SRAM 14.

After image data of the background image has been completely transferred to the display apparatus, the background is regarded as an undisplayed area to release assignment on the SRAM 14 to a background portion, and settings are changed so that image data of a foreground portion is stored in the SRAM 14.

At the time, the image data of the background image is stored in a memory in the display apparatus, and then the foreground image is drawn and transferred to the display apparatus.

Therefore, since the display controller 15 does not transfer image data of a portion not assigned a physical address in the SRAM 14 to the display unit 3, the image data of the background image remains in the display apparatus as it is. Therefore, an image in which the background image and the foreground image are combined is displayed on the display unit 3. Since an image of the background portion does not change normally, subsequent updates of drawing are made to the foreground portion.

Figure 17:
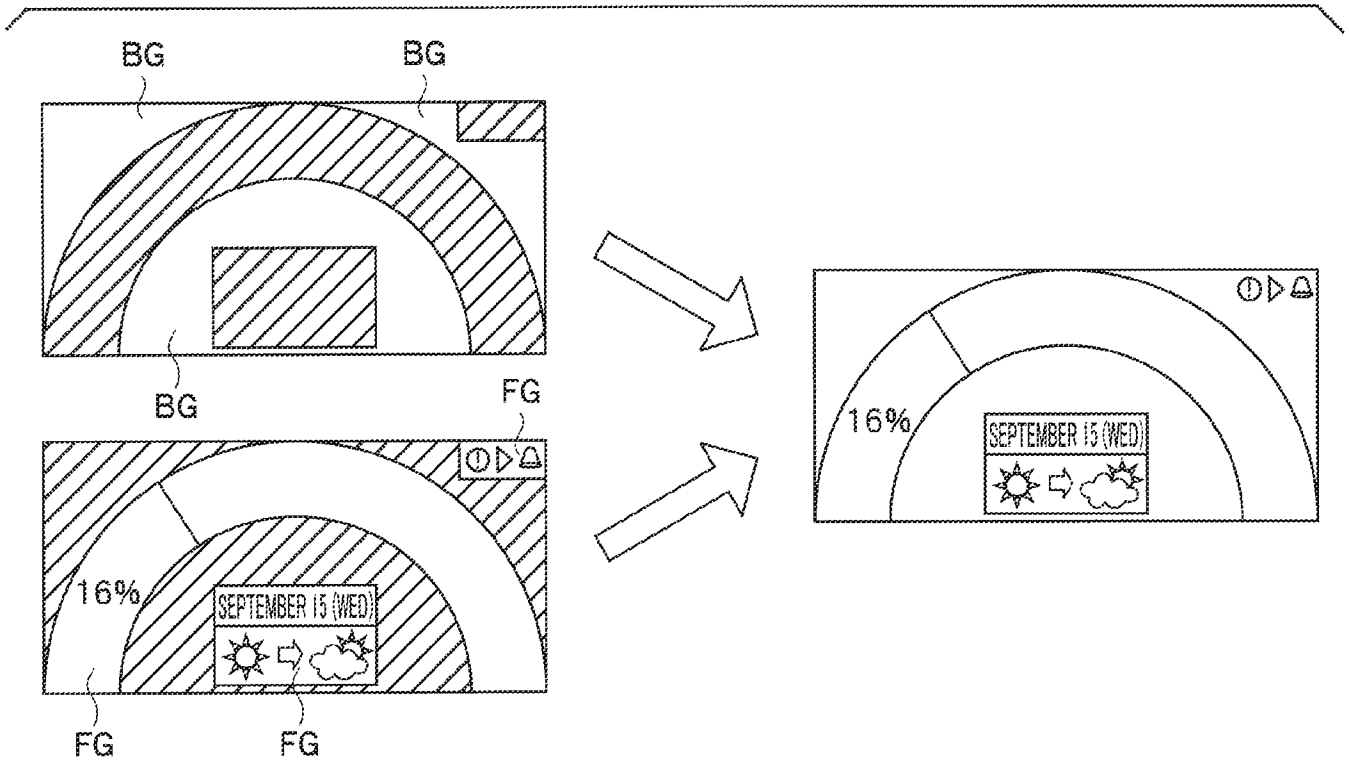
FIG. 17 is a diagram for explaining an image display method utilizing an image holding function of a display apparatus having a rectangular display area, according to an application of the first and second embodiments.

FIG. 17 is a diagram for explaining an image display method utilizing an image holding function of a display apparatus having a rectangular display area, according to an application of the first and second embodiments.

An image BG in a background image area is an image in which display content is not changed, and an image FG in a foreground image area is an image in which display content is changed. In FIG. 17, an area shown by hatched lines indicates an area with no image. That is, in the display unit 3, the image FG in the foreground image area is a display area in which image data is displayed, and the image FG in the foreground image area is fixed.

Once the display controller 15 transmits the image BG to the display unit 3, the display unit 3 continues to display the image BG. Since display content of the foreground image FG needs to be changed, the display controller 15 reads image data of the foreground image FG from the SRAM 14 at a constant cycle for output to the display unit 3.

As described above, the display controller 15 also has a function of performing processing of skipping transmission of a corresponding portion to the display unit 3 when a response to read access to the frame buffer 31 indicates an "unassigned area".

Therefore, when the read access from the display controller 15 to the frame buffer 31 is access to an "unassigned area", the transaction conversion circuit 13 returns a response to the effect to the display controller 15 by setting the area of the foreground image FG as an assigned area.

As a result, the display controller 15 does not transfer image data due to the skipping function described above. When outputting image data of the foreground image FG to the display apparatus, the display controller 15 can control a transfer start position in the display apparatus by inserting, for example, a command "set_column_address in the MIPI DSI standard".

Therefore, although the display controller 15 skips transmission of the corresponding portion to the display unit 3 when a response to the read access to the frame buffer 31 includes information indicating an "unassigned area" as described above, it is possible to reduce unnecessary transmission and therefore power consumption of equipment due to transmission of unnecessary data when using the "set_column_address" command or the like based on such information.

While certain embodiments have been described, these embodiments have been presented by way of example only, and are not intended to limit the scope of the inventions. Indeed, the novel devices and systems described herein may be embodied in a variety of other forms; furthermore, various omissions, substitutions and changes in the form of the devices and systems described herein may be made without departing from the spirit of the inventions. The accompanying claims and their equivalents are intended to cover such forms or modifications as would fall within the scope and spirit of the inventions.

What is claimed is:

1. An image drawing apparatus comprising:

a rewritable memory including a frame buffer capable of storing image data in a rectangular storage area;

a transaction conversion unit configured to convert a transaction based on a virtual address indicating a pixel position in the storage area into a transaction based on a physical address in the memory, and when the storage area is divided into a plurality of windows in a row direction and a column direction so that each of the windows includes one or more lines, and an assigned area which is assigned the physical address in the memory is set in each of the windows, configured to convert the transaction based on the virtual address into the transaction based on the physical address based on a result of determination as to whether the pixel position indicated by the virtual address is in the assigned area, wherein each of the windows includes a plurality of blocks, and the assigned area is set in units of blocks and specified by at least one assignment start block from which the assigned area is started and at least one assignment end block at which the assigned area ends in each of the windows; and a table storing information on the at least one assignment start block and the at least one assignment end block for each of the windows and a physical address of each of the windows.

2. The image drawing apparatus according to claim 1, wherein the at least one assignment start block includes a plurality of assignment start blocks, the at least one assignment end block includes a plurality of assignment end blocks, and the table stores the plurality of assignment start blocks and the plurality of assignment end blocks for of each of the windows.

3. The image drawing apparatus according to claim 1, wherein the virtual address includes an address of an unassigned area which is not assigned the physical address in the memory.

4. The image drawing apparatus according to claim 1, wherein only pixel data related to color information of an image is stored in the memory.

5. The image drawing apparatus according to claim 1, wherein the memory is an SRAM.

6. A display apparatus including:

the image drawing apparatus according to claim 1; and a display unit configured to display the image data.

7. The display apparatus according to claim 6, wherein a display area for displaying the image data is fixed in the display unit.

8. The display apparatus according to claim 6, wherein the display apparatus is a mobile terminal.

9. An image drawing apparatus comprising:

a rewritable memory including a frame buffer capable of storing image data in a rectangular storage area; and a transaction conversion unit configured to convert a transaction based on a virtual address indicating a pixel position in the storage area into a transaction based on a physical address in the memory, and when the storage area is divided into a plurality of windows in a row direction and a column direction so that each of the windows includes one or more lines, and an assigned area which is assigned the physical address in the memory is set in each of the windows, configured to convert the transaction based on the virtual address into the transaction based on the physical address based on a result of determination as to whether the pixel position indicated by the virtual address is in the assigned area, wherein when the transaction based on the virtual address is a transaction for an unassigned area which is not the assigned area, the transaction conversion unit transmits a predetermined code to a master module which outputs the transaction based on the virtual address without accessing the memory.

10. The image drawing apparatus according to claim 9, further comprising:

a display controller as the master module which controls output of the image data as display data to a display apparatus, wherein the display controller does not output the image data to the display apparatus when receiving the predetermined code.

11. An image drawing apparatus comprising:

a rewritable memory including a frame buffer capable of storing image data in a rectangular storage area; and a transaction conversion unit configured to convert a transaction based on a virtual address indicating a pixel position in the storage area into a transaction based on a physical address in the memory, and when the storage area is divided into a plurality of windows in a row direction and a column direction so that each of the windows includes one or more lines, and an assigned area which is assigned the physical address in the memory is set in each of the windows, configured to convert the transaction based on the virtual address into the transaction based on the physical address based on a result of determination as to whether the pixel position indicated by the virtual address is in the assigned area, wherein the assigned area is set in advance according to a type of each of the windows.

* * * * *